United States Patent [19]

Aoki

[11] Patent Number: 4,527,311

[45] Date of Patent: Jul. 9, 1985

[54] MAGNETIC RETAINING DEVICE FOR A BELT

[76] Inventor: Yoshihiro Aoki, No. 2-9-16, Hanahata Adachi-ku, Tokyo, Japan

[21] Appl. No.: 593,241

[22] Filed: Mar. 26, 1984

[30] Foreign Application Priority Data

Apr. 5, 1983 [JP] Japan ..... 58-50560[U]

[51] Int. Cl.[3] ..... E05C 17/56

[52] U.S. Cl. ..... 24/303; 335/285

[58] Field of Search ..... 335/286, 285, 295, 302, 335/303, 306; 24/303

[56] References Cited

U.S. PATENT DOCUMENTS 2,288,688 7/1942 Dubilier ..... 24/303 X
2,448,611 9/1948 Martin ..... 335/306 X
3,027,617 4/1962 Gray ..... 24/303
3,097,406 7/1963 Yarborough ..... 24/303 X

*Primary Examiner*—George Harris
*Attorney, Agent, or Firm*—Wenderoth, Lind & Ponack

[57] ABSTRACT

A retaining device has a base plate, a swingable plate and a permanent magnet. The swingable plate is swingably connected at its one end to the corresponding end of the base plate such that the other ends of the base plate and the swingable plate oppose each other. The permanent magnet is secured to the opposing end of either one of the base plate and the swingable plate. A retaining member is provided on the base plate to cooperate with the permanent magnet in retaining an object to be thereon, when the other end of the base plate or the swingable plate is held in close contact with the permanent magnet by the magnetic attracting force produced by the permanent magnet.

9 Claims, 23 Drawing Figures

MAGNETIC RETAINING DEVICE FOR A BELT

BACKGROUND OF THE INVENTION

1. Field of the Invention

The present invention relates to a retaining device making use of a permanent magnet and, more particularly, to a magnetic retaining device improved to produce a large retaining power which withstands a comparatively heavy load even with a permanent magnet which has only a small magnetic flux density and, hence, a comparatively small magnetic attracting force.

2. Description of the Prior Art

Hitherto, various retaining devices making use of permanent magnets have been proposed and become known. In these known retaining devices, however, the retaining power which bears the load is derived solely from the magnetic attracting power produced by the permanent magnet. Therefore, in order to attain a large retaining power, it is necessary to employ a permanent magnet having a large magnetic attracting force. For these reasons, the conventional retaining devices incorporating permanent magnets could find only limited use and the price thereof is inevitably raised due to the use of expensive permanent magnet material having a large magnetic attracting force.

SUMMARY OF THE INVENTION

Accordingly, it is a primary object of the invention to provide a magnetic retaining device improved to overcome the above-mentioned disadvantages of the prior art.

To this end, according to the invention, there is provided a retaining device comprising a base plate, a swingable plate and a permanent magnet, said permanent magnet being fixed to the inner surface of said base plate at one end of said base plate, said swingable plate being swingably connected at its one end to the other end of said base plate such that said the other end of said swingable plate opposes said permanent magnet so as to be moved into and out of contact with said permanent magnet, said swingable plate and said permanent magnet, when held in close contact with each other, cooperating with each other in retaining an object.

The above and other objects, features and advantages of the invention will become clear from the following description of the preferred embodiments taken in conjunction with the accompanying drawings.

DESCRIPTION OF THE PREFERRED EMBODIMENTS

Figure 1:
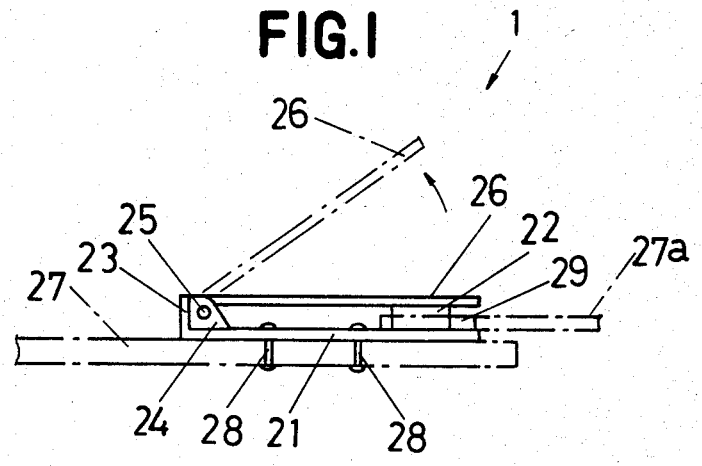
FIG. 1 is a schematic front elevational view of a retaining device embodying the present invention.
Figure 2:
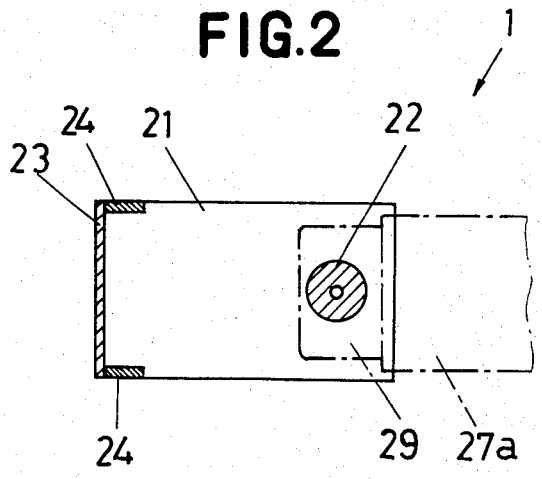
FIG. 2 is a schematic sectional plan view of the retaining device shown in FIG. 1.

Referring first to FIGS. 1 and 2, a retaining device of the invention generally designated at a reference numeral 1 has a base plate 21 made of a non-magnetic material and bent at its one end to form an upright tab 23. The retaining device 1 further has a columnar permanent magnet 22 fixed to the upper surface of the base plate 21 at the other end of the latter. A pair of bearing brackets 24,24 are provided on the front and rear ends of the upright tab 23 of the base plate 21. A shaft 25 is rotatably held by these bearing brackets 24,24. A swingable plate 26 made of iron is secured at its one end to the shaft 25 so that it is swingably supported by the bearing brackets 24,24. The other end of the swingable plate 26 is held in contact with the permanent magnet 22 by the magnetic attracting force of the latter, but can be separated from the permanent magnet 22 by being swung upwardly by manual force as indicated by an arrow in FIG. 1.

The retaining device 1 of this embodiment can be used, for example, as a fastener for fastening the lid of a bag. For such purpose, the base plate 21 is beforehand fixed to the body of the bag 27 by means of, for example, rivets 28,28. After swinging the swingable plate 26 to move the other end of the swingable plate 26 away from the permanent magnet 22, a hook ring 29 secured to a lid fastening belt 27*a* of the bag 27 is fitted around the permanent magnet 22. Then, the swingable plate 26 is swung down in the direction opposite to the arrow, thereby bringing the other end of the swingable plate 26 into close contact with the permanent magnet 22. In this case, the permanent magnet 22 serves as a retaining member and the load applied by the member to be retained, i.e. the lid of the bag in this case, acts in the horizontal direction as viewed in FIG. 1. Namely, almost no force acts against the contacting force between the permanent magnet 22 and the swingable plate 26. Thus, the retaining device 1 of this embodiment can withstand a considerably large load even when the permanent magnet 22 used in the device 1 has a comparatively small magnetic attracting force. The hook ring 29 to which the belt is secured can be inserted into the retaining device 1 and fitted around the permanent magnet 22 from any desired direction.

Figure 3:
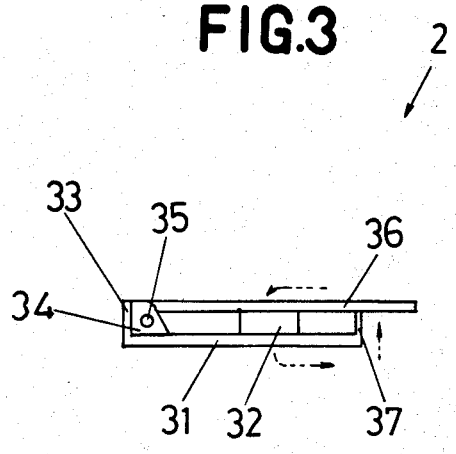
FIG. 3 is a schematic front elevational view of another embodiment of the retaining device of the invention.
Figure 4:
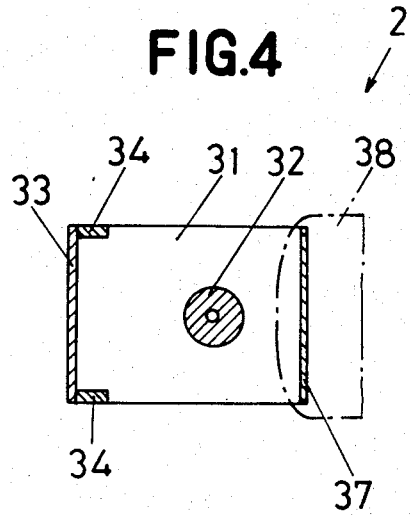
FIG. 4 is a schematic sectional plan view of the retaining device shown in FIG. 3.

FIGS. 3 and 4 show another embodiment of the retaining device in accordance with the invention. The retaining device 2 of this embodiment has a base plate 31 made of a ferromagnetic material and bent at its both end portions to provide upright tabs 33 and 37. A swingable plate 36 made of iron is swingably mounted at its one end on a pair of bearing brackets 34,34 provided on the upright tab 33, through a shaft 35 which is carried rotatably by the bearing brackets 34,34. A columnar permanent magnet 32 is fixed to the upper surface of the base plate 31 at a portion of the latter near the upright tab 37. A hook ring 38 in FIG. 4 is retained by the upright tab 37 which serves as the retaining member. In this embodiment, a magnetic circuit is formed through the permanent magnet 32, base plate 31 and the swingable plate 36 is indicated by arrows in FIG. 3. In this embodiment, it is necessary to use a permanent magnet 133 having no yoke as shown, for example, in FIG. 16.

Figure 5:
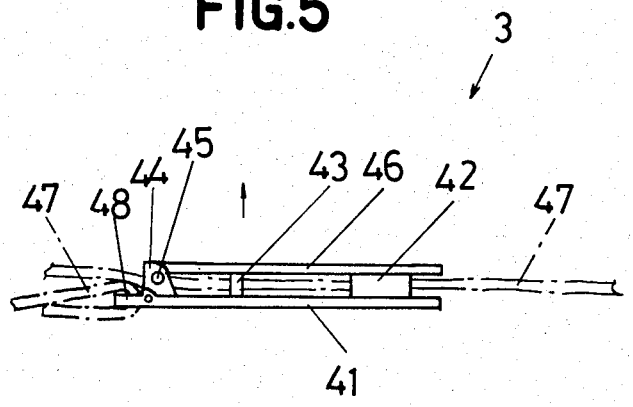
FIG. 5 is a schematic front elevational view of still another embodiment of the retaining device of the invention.
Figure 6:
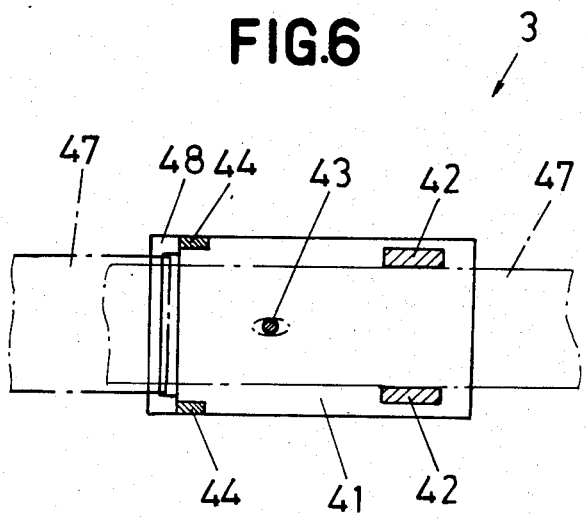
FIG. 6 is a schematic plan view of the retaining device shown in FIG. 5.

FIGS. 5 and 6 show still another embodiment. The retaining device 3 of this embodiment has a base plate 41 made of iron and provided at both sides of one end thereof with bearing brackets 44,44. A fixing 48 is attached to the same end of the base plate 41 as the bearing brackets 44,44. A swingable plate 46 is swingably mounted at its one end on the bearing brackets 44,44 through a shaft 45. As will be clearly seen from FIG. 6, a pair of permanent magnets 42,42 are attached to both side portions of the other end of the base plate 41. A retaining pin 43 serving as a retaining member is provided on the center of the upper surface of the base member 41.

The retaining device 3 can be used, for example, as the buckle of a belt. In such a case, the belt is secured at its one end to the fixing member 48 while the other end of the same is inserted into the retaining device 3 with one of the belt holes fitted to the retaining pin 43. In this retaining device 3, since the retaining pin 43 is disposed between the secured end of the swingable plate 46 and the permanent magnets 42, the swingable plate 46 is never lifted against the magnetic attracting force of the magnet 42, even though an external force is applied to swing the swingable plate 46 upwardly as indicated by an arrow in FIG. 5.

Figure 7:
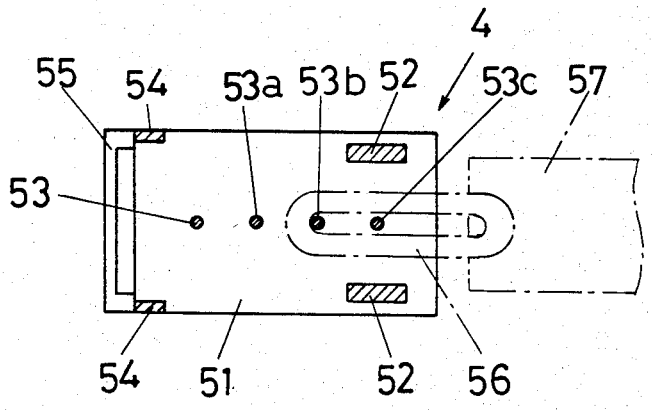
FIG. 7 is a schematic sectional plan view of a further embodiment of the invention.

FIG. 7 shows a further embodiment of the invention. The retaining device 4 of this embodiment has a series of retaining pins **53,53*a*,53*b*,53*c* arranged in a row at a constant pitch along the length of a base plate 51 made of a non-magnetic material. The constructions and functions of permanent magnets 52,52, bearing brackets 54,54 and the fixing member 55 are materially identical to the constructions and functions of corresponding members in the retaining device 3 of the preceding embodiment. In this case, a hook ring 56 connected to the belt 57 is adapted to engage selected one of the retaining pins 53,53*a*,53*b*,53*c* so that the effective length of the belt 57 can be adjusted. Since the hook ring 56 has an elongated hole as will be seen from FIG. 7, the hook ring 56 is never interfered with by other retaining pins 53, 53*a*, 53*b*, and 53*c***.

Figure 8:
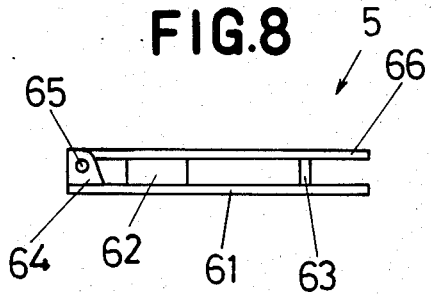
FIG. 8 is a schematic front elevational view of a still further embodiment of the retaining device of the invention.

FIG. 8 shows a still further embodiment of the invention. The retaining device 5 of this embodiment has a base plate 61 made of a non-magnetic material and provided with bearing brackets 64,64 only one of which is shown. A swingable plate 66 is swingably mounted at its one end on the bearing brackets 64,64 through a shaft 65. A pair of permanent magnets 62 is secured to both side portions of the upper surface of the base plate 61 adjacent to the end having the bearing brackets 64,64. A retaining pin 63 is secured to the other end portion of the base plate 61.

Figure 9:
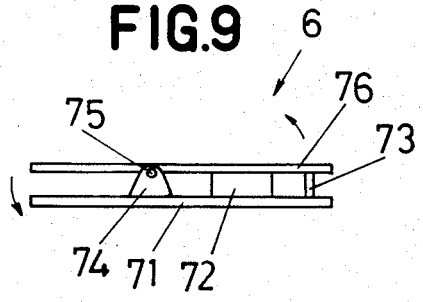
FIG. 9 is a schematic front elevational view of a different embodiment of the retaining device of the invention.

FIG. 9 shows a different embodiment of the invention having a retaining device 6 with a base plate 71 made of a non-magnetic material and provided at both sides of the central thereof with a pair of bearing brackets 74,74. A swingable member 76 is swingably supported at both sides of the central portion thereof by the bearing brackets 74,74 through a shaft 75. A permanent magnet 72 and a retaining pin 73 are disposed on the upper surface of the base plate 71 at one side of the center of the base plate 71. In this embodiment, by pressing the end of the swingable plate 76 opposite to the permanent magnet 72 as indicated by an arrow, the end of the swingable plate 76 closely contacting the magnet 72 can easily be separated and moved away from the magnet 72.

Figure 10:
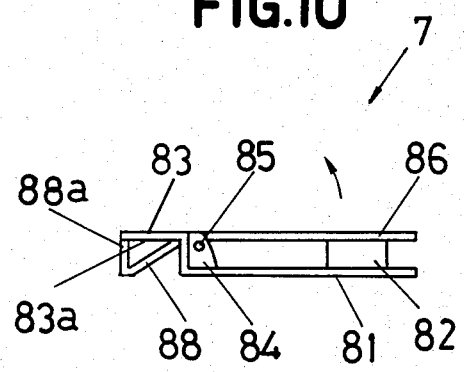
FIG. 10 is a schematic front elevational view of a different embodiment of the invention.
Figure 11:
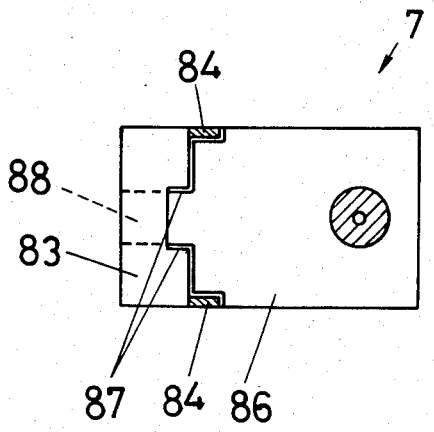
FIG. 11 is a schematic sectional plan view of the retaining device of the invention shown in FIG. 10.

FIGS. 10 and 11 show a different embodiment. The retaining device 7 of this embodiment has a base plate 81 made of a non-magnetic material bent at its one end to form a step 83. A swingable plate 86 is swingably secured to the base plate 81 through the bearing brackets 84,84 and the shaft 85. One end of the swingable plate 86 is bent in a hook-like form to provide a retaining hook 88. A permanent magnet 82 is fixed to the other end of the base plate 81. The step 83 is provided with a notch having edges 87,87 shown in FIG. 11. When the swingable plate 86 is held in close contact with the permanent magnet 82, the retaining hook 88 passes through the gap between both side edges 87,87 of the notch and the upper end **88*a* of the retaining hook 88 is stopped by the horizontal lower surface 83*a* of the step 83. However, as the swingable plate 86 is swung in the direction of the arrow in FIG. 10, the upper end 88*a* is moved downwardly away from the horizontal lower surface 83*a***.

Figure 12:
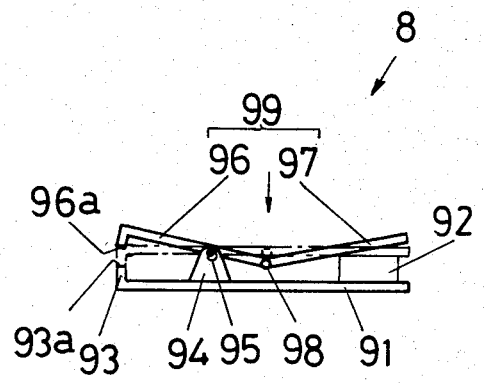
FIG. 12 is a schematic front elevational view of a different embodiment of the retaining device of the invention.

FIG. 12 shows a different embodiment of the invention. The retaining device 8 of this embodiment has a base plate 91 made of a non-magnetic material and bent at its one end to form an upright tab 93 while the other end of the same carries a permanent magnet 92 secured thereto. A swingable plate 99 is composed of a bent plate 96 and a magnetic plate 97 which are pivotally connected to each other through a pin 98. The bent plate 96 is bent at a right angle at its one end to form a bent end edge **96*a* and is swingably supported at its mid portion by a pair of bearing brackets 94,94 (only one of them is shown) provided on the base plate 91, through a shaft 95. In this embodiment, bent end edge 96*a* of the bent plate 96 and a bent end edge 93*a* of the upright tab 93 of the base plate 91 abut each other when the magnetic plate 97 is held in contact with the permanent magnet 92 by the magnetic attracting force produced by the latter. However, as the swingable plate 99 is pressed downwardly at its joint portion between the bent plate 96 and the magnetic plate 97 as indicated by an arrow, the bent end edge 93*a* is moved upwardly apart from the bent end edge 96*a*. As the swingable plate 99 is relieved from the pressing force, the magnetic plate 97 is magnetically attracted by the permanent magnet 92** into close contact with the permanent magnet 92. Consequently, the retaining device 8 as a whole resumes the bent initial position as shown by a chain line to keep the end edges 93*a* and 96*a* in contact with each other.

Figure 13:
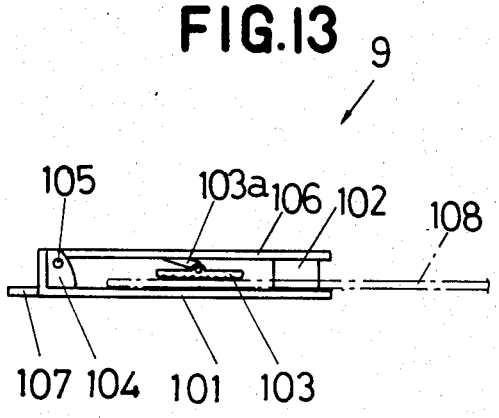
FIG. 13 is a schematic front elevational view of a different embodiment of the retaining device of the invention.

FIG. 13 shows a different embodiment of the invention. The retaining device 9 of this embodiment has a base plate 101 made of a non-magnetic material, permanent magnet 102, bearing brackets 104,104 (only one of them is shown), shaft 105, swingable plate 106, and a fixing member 107. A pressing member 103 having an undulation consisting of alternating grooves and ridges is secured rockably to the lower surface of the swingable plate 106 through an arm lever 103*a*. In this embodiment, the object to be retained, e.g. a belt 108, is clamped between the lower surface of the pressing member 103 and the upper surface of the base plate 101.

Figure 14:
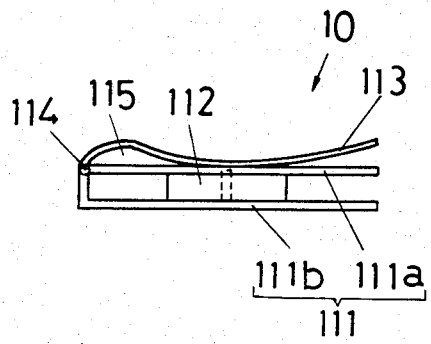
FIG. 14 is a schematic front elevational view of a different embodiment of the invention.

FIG. 14 shows a different embodiment of the invention. The retaining device 10 of this embodiment has a base plate 111 made of a non-magnetic material and having a substantially U-shaped cross-section. The base plate 111 is composed of an upper plate 111*a* and a lower plate 111*b* which are connected to each other at their ends. A permanent magnet 112 is interposed between the upper and lower plates 111*a* and 111*b*. A swingable plate 113 having a wave-like sectional shape is swingably attached at its one end through a shaft 114 to the end of the upper plate 111*a* where the latter is connected to the lower plate 111*b*. According to this arrangement, the central downward projection of the swingable plate 113 is held in close contact with the upper plate 111*a* by the magnetic attracting force produced by the permanent magnet 112. The hollow space formed between the upper plate 111*a* and the portion of the swingable plate 113 adjacent to the shaft 114 constitutes a retaining portion 115.

Figure 15:
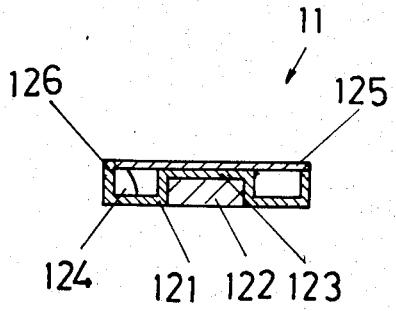
FIG. 15 is a schematic sectional front elevational view of a different embodiment of the retaining device of the invention.

FIG. 15 shows a different embodiment of the invention. The retaining device 11 of this embodiment has a base plate 121 made of a non-magnetic material and having a recess 123 formed in the mid portion of the lower surface thereof. A permanent magnet 122 is fitted in the recess 123. A swingable plate 125 is swingably attached at its one end to the base plate 121 through bearing brackets 124,124 (only one of them is shown) and a shaft 126.

In the embodiments described hereinbefore, the permanent magnets are fixed to the base plates. This arrangement, however, is not exclusive and the same advantages can be obtained even if the permanent magnets are fixed to the swingable plates. It is also possible to directly fix the base plate 41,51 or 101 to the belt, hand bag or the like object by means of screws or rivets, insteadly of using the fixing members such as those designated at numerals 48,55 and 107 in FIGS. 6,7 and 13.

Figure 16:
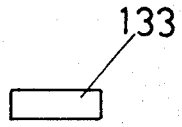
FIGS. 16 to 19 are schematic sectional front elevational views of various forms of permanent magnet incorporated in the retaining device of the invention.
Figure 17:
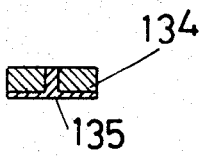
Figure 18:
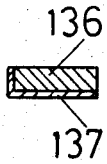
Figure 19:
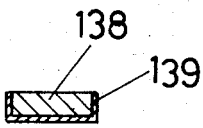
Figure 20:
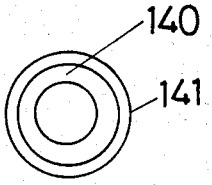
FIGS. 20 and 21 are schematic plan views of other forms of the permanent magnet incorporated in the retaining device of the invention.
Figure 21:
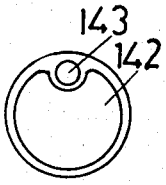

The permanent magnets used in the described embodiment can have various forms as shown in FIGS. 16 through 23. More specifically, FIG. 16 shows a permanent magnet 133 having no yoke, while FIGS. 17 to 23 show permanent magnets 134, 136, 138, 140, 142, 144 and 146 having yokes 135, 137, 139, 141, 145 and 147,148, respectively. When no yoke is used, the base plate has to be made of a ferromagnetic material. To the contrary, when a yoke is used, the base plate should be made of a non-magnetic material.

Figure 22:
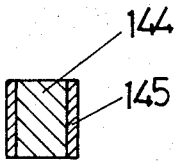
FIGS. 22 and 23 are schematic sectional front elevational view of other forms of the permanent magnet incorporated in the retaining device of the invention.
Figure 23:
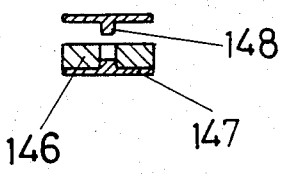

The yoke, when used, can have various forms such as an inversed T-shape (see FIG. 17), an L-shape (see FIG. 18), a U-shape (see FIG. 19), a bowl-like shape (see FIGS. 20 and 21) and a plate-like shape (see FIG. 22). The yoke may be integrated with the permanent magnet as shown in FIGS. 17 to 22, or may be constructed in two separate pieces one of which is integrated with the permanent magnet while the other is secured to the object to be fixed, as shown in FIG. 23.

As has been described, according to the invention, there is provided a retaining device having a permanent magnet fixed to a base plate or a swingable plate, and a retaining member which retains an object in cooperation with the magnet when the base plate or the swingable plate is held in close contact with the permanent magnet due to the magnetic attracting force produced by the permanent magnet. Therefore, the load imposed by the object to be retained is borne by the retaining member regardless of the magnetic attracting force of the magnet. Consequently, the retaining device of the invention can produce a strong retaining power to bear a heavy load, even with a permanent magnet which has a comparatively small magnetic flux density, i.e. a comparatively small magnetic attracting power.

The retaining device of the invention, therefore, can be used satisfactorily even for uses requiring a large retaining force which could never be produced by the conventional retaining device relying solely upon the magnetic retaining force, such as buckles of belts, buckles of shoulder straps of bags, fasteners for lids of bags, and so forth. Thus, the invention offers a great advantage to widen the use of the retaining device incorporating a permanent magnet, without any restriction due to the production cost and size. Furthermore, the invention permits a reduction in the size of the retaining device without being accompanied by any reduction in the retaining power. Therefore, the retaining device of the invention can be used for comparatively small objects such as necklaces, bracelets, wrist watch bands, fasteners of garments, and so forth.

What is claimed is:

1. A retaining device comprising:

a fastening belt having two ends, a base plate having two ends and being attached on an outer surface to one end of the fastening belt, a permanent magnet being fixed to an inner surface of said base plate near one end of said base plate, a swingable plate having two ends and being swingably connected at its one end to the other end of said base plate such that the other end of said swingable plate opposes said permanent magnet so that the swingable plate may be moved into and out of contact with said permanent magnet, a hook ring means, being attached to the other end of the fastening belt, for encircling the permanent magnet so that said swingable plate and said permanent magnet, when held in close contact with each other, cooperate with each other to retain the hook ring means of the fastening belt therebetween.

2. A retaining device according to claim 1, wherein said base plate is bent at its one end to form a step, and wherein said swingable plate is bent at its one end to form a retaining hook, the end edges of said step and said retaining hook abutting each other when the other end of said swingable plate is held in close contact with said permanent magnet, thereby retaining the hook ring means therebetween.

3. A retaining device according to claim 1, wherein said swingable plate is constituted by a bent plate and a magnetic plate which are pivotally connected to each other, an end edge of a bent tab of said bent plate and an end edge of a bent tab of said base plate abutting each other when said magnetic plate is held in close contact with said permanent magnet, thereby retaining the hook ring means therebetween.

4. A retaining device according to claim 1, further comprising:

a pressing member having a multiplicity of alternating grooves and ridges rockably attached to a lower surface of said swingable plate through an arm lever, so that said hook ring means is also clamped between said swingable plate and said base plate.

5. A retaining device according to claim 1, wherein:

said base plate is composed of an upper plate and a lower plate which are connected at their one ends and which have a space therebetween, said swingable plate has a wave-like sectional shape, and said permanent magnet is disposed in the space between said upper and lower plates and is secured to said upper and lower plates.

6. A retaining device according to claim 1, further comprising:

recess defining means, formed in a lower surface of said base plate, for fitting the permanent magnet therein.

7. A retaining device comprising:

a fastening belt having two ends, a base plate having two ends and being bent upwardly at its one end, a permanent magnet being fixed to a midportion of an inner surface of the base plate, a swingable plate having two ends and being swingably connected at its one end to the another end of the base plate, and a hook ring encircling at one end the upwardly bent one end of the base plate and being attached at the other end to one end of the fastening belt, whereby the swingable plate may be moved into and out of contact with the permanent magnet so that the swingable plate and the permanent magnet, when held in close contact with each other, cooperate with each other to retain the hook ring therebetween.

8. A retaining device comprising:

a fastening belt having two ends, a base plate having two ends and being attached at one end to one end of the fastening belt, at least one permanent magnet means, being fixed to an inner surface of the base plate at the other end of the base plate, for guiding the other end of the fastening belt over the inner surface of the base plate, a swingable plate having two ends and being swingably connected at its one end to the one end of the base plate, and at least one pin means, provided in the base plate, for retaining the other end of the fastening belt, whereby the swingable plate may be moved into and out of contact with the at least one permanent magnet means so that the swingable plate and the at least one permanent magnet means, when held in close contact with each other, cooperate with each other to retain the other end of the fastening belt therebetween.

9. The retaining device according to claim 8, wherein:

said at least one permanent magnet means includes two permanent magnets arranged one on each side of the fastening belt therebetween, and said at least one pin means includes a plurality of retaining pins arranged in a row.

* * * * *